US008573422B1

(12) United States Patent
Dillon

(10) Patent No.: US 8,573,422 B1
(45) Date of Patent: Nov. 5, 2013

(54) ALUMINUM CHAMPAGNE BOTTLE

(76) Inventor: Thomas W Dillon, Sun Tan Valley, AZ (US)

( * ) Notice: Subject to any disclaimer, the term of this patent is extended or adjusted under 35 U.S.C. 154(b) by 84 days.

(21) Appl. No.: 13/172,671

(22) Filed: Jun. 29, 2011

Related U.S. Application Data

(60) Provisional application No. 61/360,983, filed on Jul. 2, 2010.

(51) Int. Cl.
*B65D 41/14* (2006.01)
*B65D 41/48* (2006.01)

(52) U.S. Cl.
USPC ..... 215/45; 215/42; 215/43

(58) Field of Classification Search
USPC ..... 215/45, 42, 43
See application file for complete search history.

(56) References Cited

U.S. PATENT DOCUMENTS

| | | | | |
|---|---|---|---|---|
| 2,116,199 | A * | 5/1938 | Held | 228/154 |
| 3,164,287 | A * | 1/1965 | Williamson | 220/288 |
| 3,961,719 | A * | 6/1976 | Pierlot et al. | 215/277 |
| 5,071,042 | A | 12/1991 | Esposito | |
| 5,718,352 | A | 2/1998 | Diekhoff | |
| 5,884,679 | A | 3/1999 | Hansen | |
| 6,010,026 | A * | 1/2000 | Diekhoff et al. | 220/288 |
| 6,010,028 | A | 1/2000 | Jordan | |
| 6,588,614 | B2 | 7/2003 | Neuner | |
| 2005/0067365 | A1 | 3/2005 | Hanafusa | |
| 2007/0090078 | A1 * | 4/2007 | Laveault et al. | 215/12.2 |

* cited by examiner

*Primary Examiner* — Anthony Stashick
*Assistant Examiner* — Jennifer Castriotta
(74) *Attorney, Agent, or Firm* — Bert Krages

(57) ABSTRACT

An aluminum bottle suitable for containing sparkling beverages such as champagne. The finish portion of the bottle comprises a collar which fits over the neck of the bottle to form a muselet flange.

15 Claims, 3 Drawing Sheets

ALUMINUM CHAMPAGNE BOTTLE

CROSS-REFERENCED TO RELATED APPLICATIONS

This application is a nonprovisional application of U.S. application Ser. No. 61/360,983 filed on Jul. 2, 2010, which is incorporated by reference herein in its entirety.

FIELD OF THE INVENTION

The invention relates generally to an aluminum bottle of the type useful for containing sparkling wines and a method of manufacturing said bottles.

BACKGROUND OF THE INVENTION

Champagne bottles are used primarily as containers for carbonated or sparkling wines. In this application, the term "champagne" refers to all sparkling wines and not just those from that region of France. Champagne, being carbonated, has traditionally been contained in round heavy glass bottles because round bottles are stronger than other shapes. In recent years, aluminum beverage bottles have become accepted in the general marketplace for beverages, in part because of their appeal as an environmentally-preferable alternative to plastic bottles. The dominant use of aluminum bottles has been to contain soft drinks, beer, and sports drinks. Bottles made to be used with such beverages are designed to work with industry standard closures and caps such as the 26 mm standard crown cap, 38 mm continuous thread with plastic sleeve, and 28 mm continuous thread finishes.

The "finish" portion of a champagne bottle is the portion above the upper terminus of the neck and consists of the bottle lip and a muselet flange. Although it is feasible to manufacture a single-piece champagne aluminum bottle with a muselet flange shaped to receive a muselet, as is traditional for glass champagne bottles, such manufacturing will form a recess inside the bottle at the point where the muselet flange is located. This recess presents several problems with respect to champagne bottles. First, during the process of making champagne, the bottle is capped, typically with a crown cap, and turned upside down to enable the dead yeast to settle at the mouth. The bottle is then frozen, uncapped, and the frozen plug of dead yeast is removed. The recess thus presents a problem because the plug can get wedged in the formed recess and not expel properly. Another problem is that the cork can expand into the recess and make removal more difficult and possibly more dangerous. In addition, the recess is located near the opening and thus can interfere with the smooth flow of the contents when being poured or consumed from the bottle. Thus, there is a need for a cost-efficient means of manufacturing aluminum champagne bottles that maintain a smooth interior profile in the area of the finish.

SUMMARY OF THE INVENTION

The primary embodiment of the bottle assembly is formed from two pieces. The first piece is a preformed aluminum bottle having a neck section, a body section, and a bottom. The bottle may or may not have a shoulder between the neck section and the body. The second piece is a collar having at an upper section with a diameter slightly larger than the upper neck section of the bottle, a transition section in the middle, and a lower section that features a flange capable of enabling a muselet to be secured to the bottle. The neck of the bottle may be formed with a taper and at least part of the collar being formed with a slightly-larger diameter but equivalent degree of taper so that when the collar is placed onto the neck of the bottle for assembly, the final placement of the collar is determined by where the tapered inner surface of the collar engages the tapered outer surface of the neck section.

The bottle assembly is made by sliding the collar over the neck of the bottle until the collar and bottle engage at the desired position as determined by the tapers or protrusions described above. The upper end of the bottle is then rolled to form a bottle lip which serves as the surface for mating a cork or crown cap to the bottle and also as a pouring surface. If desired, the rolling step used to form the bottle lip can concurrently form a crimp connection encompassing the bottle lip and the upper portion of the collar to more firmly secure the collar to the bottle. However, such crimping is not essential because, once formed, the bottle lip acts to prevent the collar from sliding off the neck. Alternatively, the collar may be more firmly secured to the neck of the bottle by means such as adhesives or welding.

The lower portion of the collar is formed to extend a short distance from the neck of the bottle and thus forming a flange by which the muselet may be secured to the bottle. The purpose of the muselet is to restrain the cork onto the bottle. The collar can be made of various suitable materials although metal or plastic are preferred. If the collar is made of plastic, the plastic should have sufficient thickness and rigidity to withstand the upward force exerted by the muselet once it is fastened to the flange. With plastic collars, the flange can be formed at the time the plastic is molded. If the collar is made of metal, it should likewise have a suitable thickness and rigidity. The middle section of a metal collar should preferably be tapered at an angle between 20 to 50 degrees from the vertical so as to cause the diameter of the lower portion to extend a short distance away from the neck of the bottle and thus provide a suitable surface for securing a muselet. If desired for the sake of efficacy, appearance, or to eliminate a possible cutting hazard, the shape of the flange may be modified by rolling it inwards or outwards respective to the bottle.

An alternative embodiment is also shown in the figures as a "quick cork" consists of a bottle assembly in which a restraining shroud is used to hold down the cork instead of a muselet. The shroud may range in form such as being a cap that completely covers the cork or a strap that partially covers the cork. In this alternative embodiment, the lower section of the collar may be bifurcated into tabs on opposing sides that extend downward from the upper or middle section of the collar. The restraining shroud is sized to fit over the cork and has indentations or openings that engage the protrusions on the tabs so as to secure the shroud onto the bottle. The collar is preferably sufficiently long to extend beneath the bottom edge of the retaining shroud. To open the bottle, the bottom section of the collar is pressed inwards on opposing sides to cause the protrusions to disengage from the indentations or openings in the retaining shroud. The shroud is then removed which subsequently allows for the cork to released from the bottle.

DESCRIPTION OF THE PREFERRED EMBODIMENTS

As used in the following description, terms such as upward, downward, inward, and outward are used with reference to a bottle orientated in an upright manner with the mouth facing upward. The same applies to other directional terms such as upper, lower, and bottom.

Figure 1:
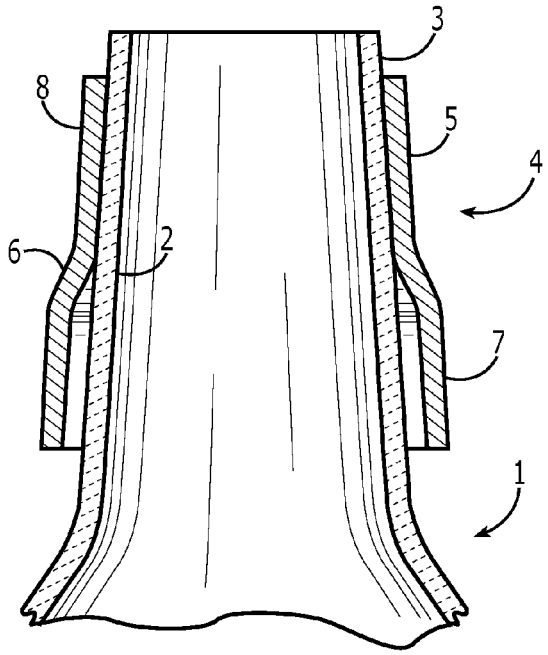
FIG. 1 is a side view showing the neck of a preformed aluminum bottle and a collar inserted onto the neck thereof.

FIG. 1 shows a preformed aluminum bottle 1 having a neck section 2 with a distal opening end 3. The neck section 2 of the bottle 1 should have some degree of taper. Also shown is a preformed collar 4 having of a upper section 5 with a diameter slightly larger than the upper portion of the neck section 2, a transition section 6 in the middle, and a lower section 7 which has a diameter sufficiently greater than the diameter of the upper section 5 so as to enable a flange to be formed around the bottle capable of supporting a muselet when rolled as described below. The middle section 6 is preferably tapered at an angle between 20 to 50 degrees from the vertical. The neck 2 may be formed with a taper and the upper section 5 of the collar 4 may be formed with a slightly-larger diameter but equivalent degree of taper so that when placed onto the neck 2, the placement of the collar 4 is determined by where the tapered inner surface of the collar 4 engages with the tapered outer surface of the neck 2. If desired, the collar may be further secured to the bottle by means such as adhesives, spot welding, press fit, or by heating the collar 4 prior to placement so as to increase the diameter of the upper section 5 by thermal expansion which results in a friction fit after the collar 4 cools.

Figure 2:
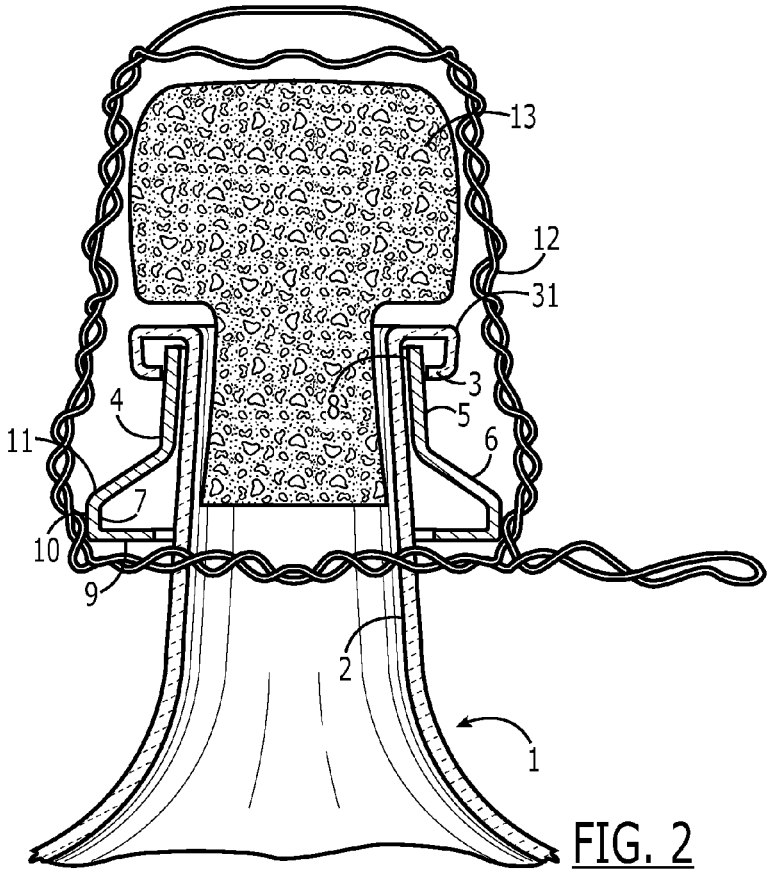
FIG. 2 is a side view showing an embodiment having a muselet flange formed by bending the bottom of the collar towards the neck of the bottle.

FIG. 2 shows the bottle 1 in which the distal opening end 3 has been rolled over to form a bottle lip 31. Preferably, the bottle lip 31 is curled outwardly so as to prevent trapping of the contents of the bottle 1 within the confines of the bottle lip 31 during pouring. The collar 4 is further secured to the bottle 1 by rolling the distal opening end 3 over the distal portion 8 of upper section 5 and forming an outward facing curl that overlaps and crimps the distal portion 8 between the bottle lip 31 and the neck 2.

The lower section 7 of the collar 4 may be bent into the form of an inward-facing muselet flange assembly 11 comprising a substantially horizontal bottom member 9 and a outer member 10 which is connected to the transition section 6. However, it should be noted that it is not necessary to bend the lower section 7 for it to serve the function of providing a structure to which the muselet 12 may be secured. As shown in FIG. 2, the inward-facing muselet flange assembly 11 provides a structure to which the muselet 12 can be secured by twist fastening it just beneath the muselet flange assembly 12 in order to hold the champagne cork 13 onto the bottle 1. If the lower section 7 is not bent to form a muselet flange assembly, the muselet 12 is secured by twist fastening it just beneath the lower section 7. The champagne cork 13 is of the kind used for the sealing of traditional champagne and sparkling wine bottles and includes traditional champagne corks as well as plastic champagne stoppers.

Figure 3:
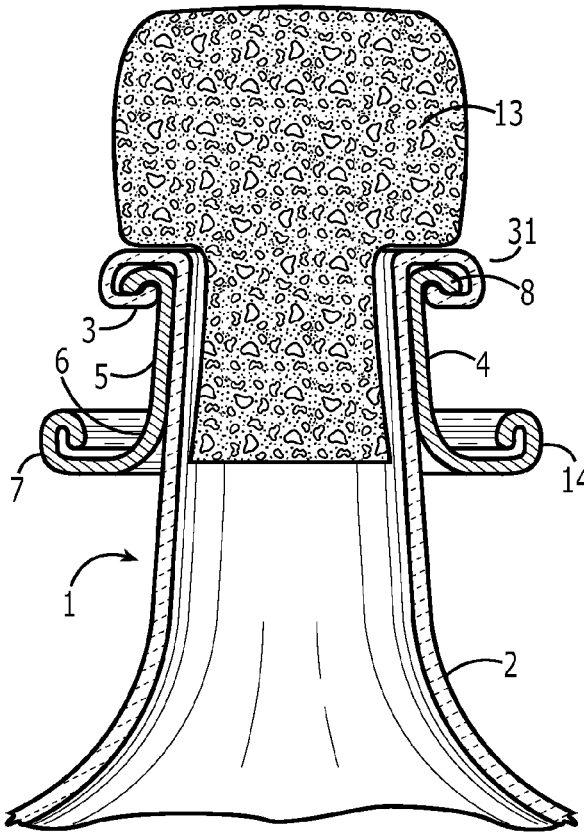
FIG. 3 is a side view showing an embodiment having a muselet flange formed by bending the bottom of the collar away from the neck of the bottle.

FIG. 3 shows another embodiment of the bottle 1 depicting variations on how the bottle lip 31 and collar 4 may be bent and formed. In one variation, the collar 4 is positioned so that the distal portion 8 is relatively close to the distal opening end so that when the distal opening end 3 is rolled to form the bottle lip 31, the distal portion 8 is concurrently rolled and trapped within the bottle lip 31. In another variation, the lower section 7 of the collar 4 is rolled in an upwards and outwards direction to form an outward-facing muselet flange assembly 14.

Figure 4:
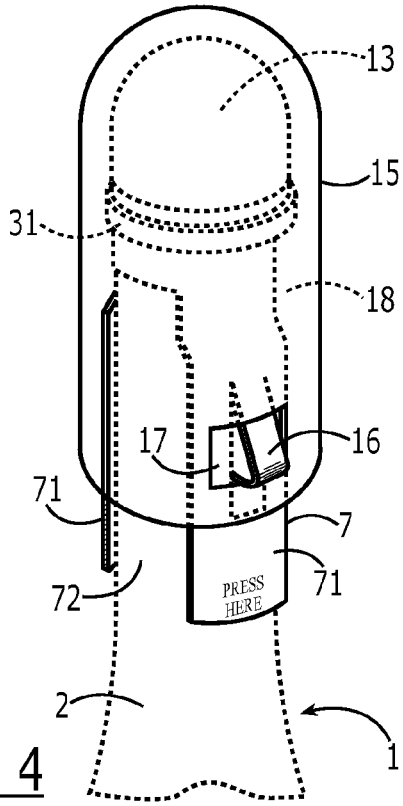
FIG. 4 is a perspective view showing a shroud securing the cork and attached to tabs protruding from the collar.

FIG. 4 depicts an embodiment in which the champagne cork 13 is secured to the bottle 1 by a shroud 15 having detent openings 17 on opposing sides. The shroud 15 may be in the form of a cap that fully encloses the cork as shown in FIG. 4 or it can be in a narrower form such as a strap. The collar 18 has detents 16 that are located on opposing sides such that they engage the detent openings when the shroud 15 is lowered over the champagne cork 13 and neck 2. When the shroud 15 is attached to the collar 18 in this manner, it restrains the champagne cork 13 from popping out of the bottle 1. The shroud 15 may be disengaged from the bottle 1 by depressing the lower section 7 of the collar in the vicinity of the detents 16, thus causing the detents 16 to move towards the neck 2 of the bottle 1 and disengage the detent openings thus allowing the shroud 15 to be removed upwards and away from the bottle 1. FIG. 4 depicts a collar 18 in which the lower section 7 consists of two tabs 71 that are separated by spaces 72 between them. However, it should be noted that such spaces 72 are not necessarily required to facilitate disengagement of the detents 16 from the detent openings 17 because sufficient compression of the lower section 7 can still permit disengagement even without such spaces 72. Furthermore, in another variation the shroud 15 may be constructed with protrusions (not shown) facing inwards that engage corresponding openings (not shown) on the collar 4. In this variation, the shroud 15 is disengaged from the collar 4 in same manner as described above, namely by depressing the collar 4 in the vicinity of the openings thus causing them to disengage from the protrusions.

Figure 5:
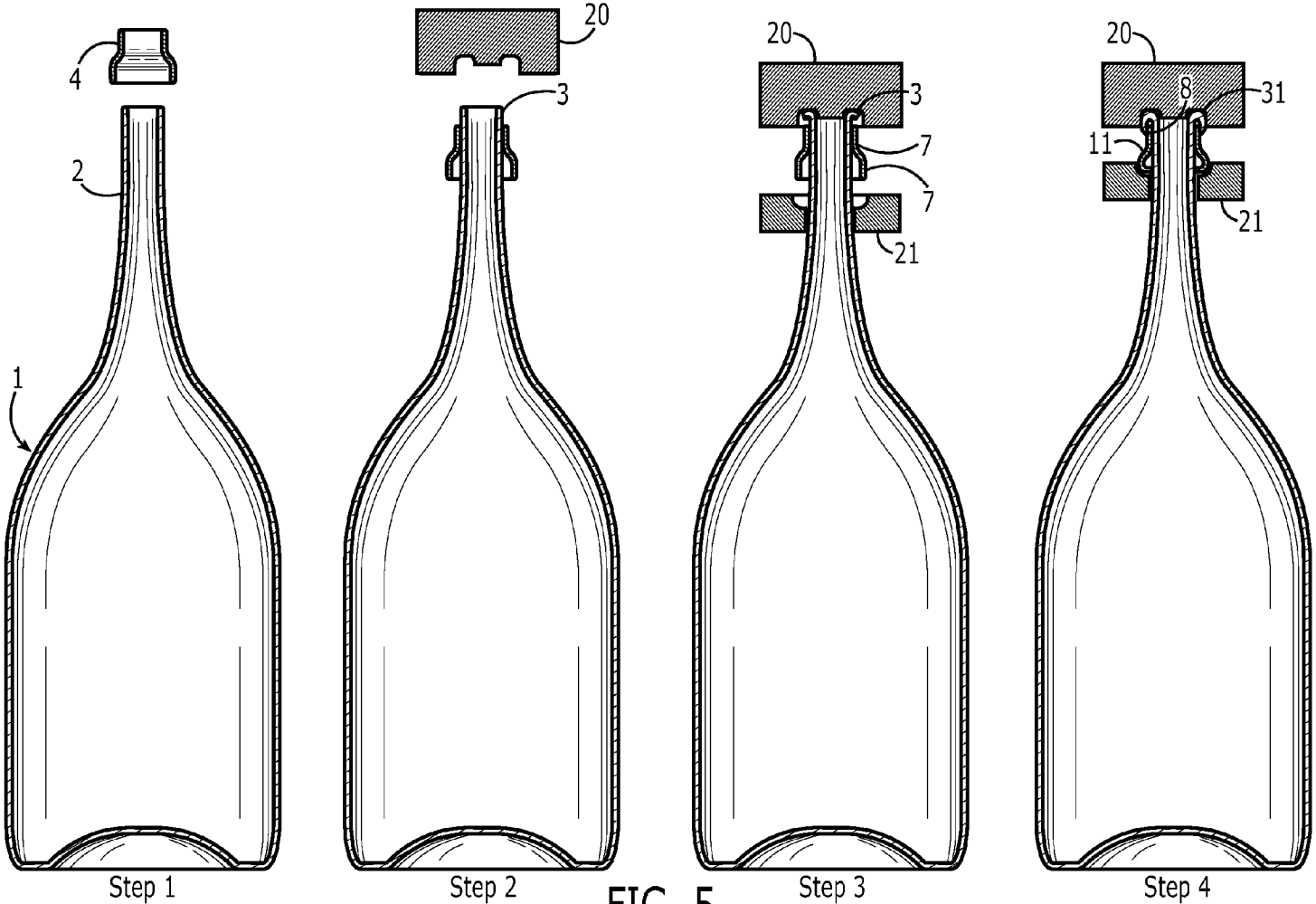
FIG. 5 depicts the steps of a method of forming the collar into a muselet flange.

FIG. 5 shows four steps of a method of manufacturing the finish of an aluminum champagne bottle 1. In the first step, the collar 4 is positioned onto the neck 2 of the bottle. In the second step, an upper die 20 is lowered onto the distal opening end 3 of the bottle 1. During the third step, the upper die 20 exerts a downward force on the distal opening end 3 causing said end to bend outwards. Simultaneously, a lower die 21 is placed around the neck 2 at a location beneath the collar 4 in a position to make contact with the collar 4. During the fourth step, the upper die 20 continues to exert a downwards force on the distal opening end 3 causing it to continue to bend until it forms a bottle lip 31. During the course of step 4, the bottle lip 3 makes contact with the distal portion 8 of the collar and thus trapping it between the bottle lip 3 and the neck 2. Meanwhile, the lower die 21 exerts a force against lower section 7 of the collar causing the lower section 7 to be formed into a muselet end assembly. Depending on the shape of the lower die 21, either an inward-facing muselet assembly 11 as shown in FIGS. 2 and 5 or an outward facing muselet assembly 14 as shown in FIG. 3. may be formed. Other methods of manufacturing the finish of the bottle can be used. For example, a collar 4 can be preformed to encompass a muselet flange assembly prior to insertion onto the neck 2 of the bottle 1. In this variation, it would only be necessary to use an upper die 20 to secure the distal opening end 3 to the upper section 5 of the collar.

The preferred material for the bottle is aluminum, particularly the aluminum alloys generally used for making aluminum cans and bottles. However, other metals such as stainless steel can be used. Various materials are suitable for the collar including aluminum, other metals, and plastic. An advantage of plastic is that the collar may be made with an integral flange during the molding process.

Although the invention has been described in detail with reference to the preferred embodiments, other embodiments can achieve the same results. Variations and modifications of the present invention will be apparent to those skilled in the art and it is intended to cover all modifications and equivalents.

I claim:

1. A bottle assembly comprising:

a metal bottle having an outer surface and a tapered neck portion connected to a bottle lip;

a collar having a top edge, bottom edge, smooth inner wall, smooth outer wall, and a flange;

said inner wall of said collar having a continuous nonparallel taper from the top edge to said flange;

said outer wall of said collar having a continuous nonparallel taper from the top edge to said flange;

said inner wall of said collar fitted over said outer surface of said neck portion and beneath the bottle lip;

said bottle assembly having a radial space between said flange and said bottle neck; and said flange that is suitable for securing a muselet.

2. The bottle assembly of claim 1 in which the bottle is made of aluminum alloy and is secured to said collar by a weld.

3. The bottle assembly of claim 1 in which the collar is made of plastic and is secured to said bottle by a weld.

4. The bottle assembly of claim 1 in which said flange comprises the bottom edge of the collar.

5. The bottle assembly of claim 1 in which said flange comprises the bottom edge of the collar and said flange has a bend of the bottom edge towards the neck portion.

6. The bottle assembly of claim 1 in which said flange comprises the bottom edge of the collar, and said flange has a bend of the bottom edge away from the neck portion.

7. The bottle assembly of claim 1 in which a portion of the collar is crimped between the bottle lip and neck portion.

8. A bottle assembly comprising a a metal bottle having a neck portion connected to a bottle lip;

a collar having a smooth inner wall, smooth outer wall, bottom edge, and a top edge, said collar fitted over said neck portion and beneath the bottle lip and having a flange located at said bottom edge;

said bottle assembly having a radial space between said flange and said bottle neck;

a muselet having an upper end and a bottom end;

a champagne cork;

said upper end of said muselet positioned over said champagne cork; and said bottom end of said muselet secured beneath said flange and in contact with said neck portion.

9. The bottle assembly of claim 8 in which the bottle is made of aluminum alloy and is secured to said collar by a weld.

10. The bottle assembly of claim 8 in which the collar is made of plastic and is secured to said bottle by a weld.

11. The bottle assembly of claim 8 in which said flange has a bend of the bottom edge towards the neck portion.

12. The bottle assembly of claim 8 in which said flange has a bend of the bottom edge away from the neck portion.

13. The bottle assembly of claim 8 in which a portion of the collar is crimped between the bottle lip and neck portion.

14. The bottle assembly of claim 8 in which the top edge of the collar is rolled and trapped within the bottle lip.

15. The bottle assembly of claim 8 in which said bottle lip is configured into a rolled shape suitable for attaching a crown cap such that the bottle lip is situated above the top edge of the collar and does not form a crimp connection.

* * * * *